US006972074B2

(12) United States Patent
Nenonen et al.

(10) Patent No.: US 6,972,074 B2
(45) Date of Patent: Dec. 6, 2005

(54) EQUIPMENT FOR FABRIC GUIDING IN A PAPER MACHINE

(75) Inventors: Ville Nenonen, Helsinki (FI); Samppa J. Salminen, Jyväskylä (FI); Risto Väätänen, Helsinki (FI)

(73) Assignee: Metso Paper, Inc, Helsinki (FI)

( * ) Notice: Subject to any disclaimer, the term of this patent is extended or adjusted under 35 U.S.C. 154(b) by 135 days.

(21) Appl. No.: 10/695,483

(22) Filed: Oct. 28, 2003

(65) Prior Publication Data

US 2004/0129753 A1 Jul. 8, 2004

(30) Foreign Application Priority Data

Oct. 29, 2002 (FI) ..... 20021922

(51) Int. Cl.[7] ..... D21F 5/00

(52) U.S. Cl. ..... 162/289; 162/300; 162/272; 162/273; 162/274; 162/193; 162/200; 162/203; 226/21; 226/22; 226/23; 226/170; 226/174

(58) Field of Search ..... 162/289, 300, 162/272–274, 193, 200–203; 226/21–23, 226/170, 174

(56) References Cited

U.S. PATENT DOCUMENTS

| | | | | |
|---|---|---|---|---|
| 3,750,920 | A * | 8/1973 | Fountain et al. | 226/23 |
| 5,500,090 | A * | 3/1996 | Autio | 162/273 |
| 6,627,044 | B2 * | 9/2003 | Suortti et al. | 162/273 |
| 6,669,817 | B2 * | 12/2003 | Savela | 162/274 |

* cited by examiner

*Primary Examiner*—Mark Halpern
(74) *Attorney, Agent, or Firm*—Stiennon & Stiennon

(57) ABSTRACT

Equipment for fabric guiding in a paper machine has a fabric (10) and rolls (12–18) adapted to support it. In connection with the roll (17) end there is arranged equipment comprising a stand (19) and a nip guard (26). The stand (19) includes a transfer base (20) as well as transfer equipment (22) for moving the transfer base (20). The equipment further comprises an edge detector (23) for the roll (17) arranged on the opposite side of the fabric (10), for which edge detector there is a vertical bracket (25) arranged in the stand (19). The vertical bracket (25) and the nip guard (26) form an integrated sheet-metal construction.

9 Claims, 4 Drawing Sheets

EQUIPMENT FOR FABRIC GUIDING IN A PAPER MACHINE

CROSS REFERENCES TO RELATED APPLICATIONS

This application claims priority on Finnish Application No. 20021922, Filed Oct. 29, 2002.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to equipment for fabric guiding in a paper machine.

U.S. Pat. No. 5,500,090 makes known equipment for fabric guiding in a paper machine. In the equipment set forth the edge detectors are placed after the roll, in the travel direction of the fabric, separated from the stand. However, sets of equipment are also known in which the edge detectors are attached to the stand.

Independent of the location point, special vertical brackets are needed for supporting the edge detectors in an appropriate manner. Usually the vertical bracket is assembled from machined components, which are attached to the paper machine frame or to the said stand. In addition, a so-called nip guard is required at the equipment for preventing accidents.

The production of a sufficiently rigid vertical bracket requires high material strengths. Consequently, several machining steps are needed in the production, and the final vertical bracket becomes heavy and expensive. In spite of the massive construction, in practical use the vertical bracket vibrates as the roll rotates, and thus disturbs the operation of the edge detectors. Furthermore, the nip guard requires fastening elements of its own, which makes the total equipment complex and expensive to produce, yet sensitive to vibrations and difficult to locate in various positions.

The object of this invention is to provide novel equipment for fabric guiding in a paper machine, being simpler than heretofore, yet stronger and easier to manufacture. The equipment according to the invention unexpectedly utilizes sheet metal in particular for the manufacture of the vertical brackets. Consequently, the final equipment is lighter in weight, yet more rigid than heretofore. In addition, the support structures of the equipment are easier and quicker to manufacture than heretofore while the dimensional accuracy is, however, better than known in the art. In the equipment according to the invention various constructions are additionally combined, which reduces the number of components and machining steps required in production.

It is an object of this invention to provide equipment for fabric guiding in a paper machine comprising at least one fabric arranged as an endless loop as well as rolls adapted to support it, for which rolls there is arranged, at the end of at least one of these rolls, equipment that includes a stand adapted to attach to the paper machine frame, a nip guard in the stand at the gaps formed by the roll and the fabric, a transfer base movably adapted to the stand, transfer equipment for moving the transfer base in relation to the stand, at least one edge detector for the roll, arranged on the opposite side of the fabric for determining the fabric position, in the axial direction of the roll, a vertical bracket arranged in the stand for the edge detector, whereby the roll end supported with the equipment is adapted to be set according to the edge detector by means of the transfer equipment, for keeping a desired fabric position at the rolls. The invention is described below in detail by making reference to the enclosed drawings, which illustrate one of the embodiments of the invention

DESCRIPTION OF THE PREFERRED EMBODIMENTS

Figure 1:
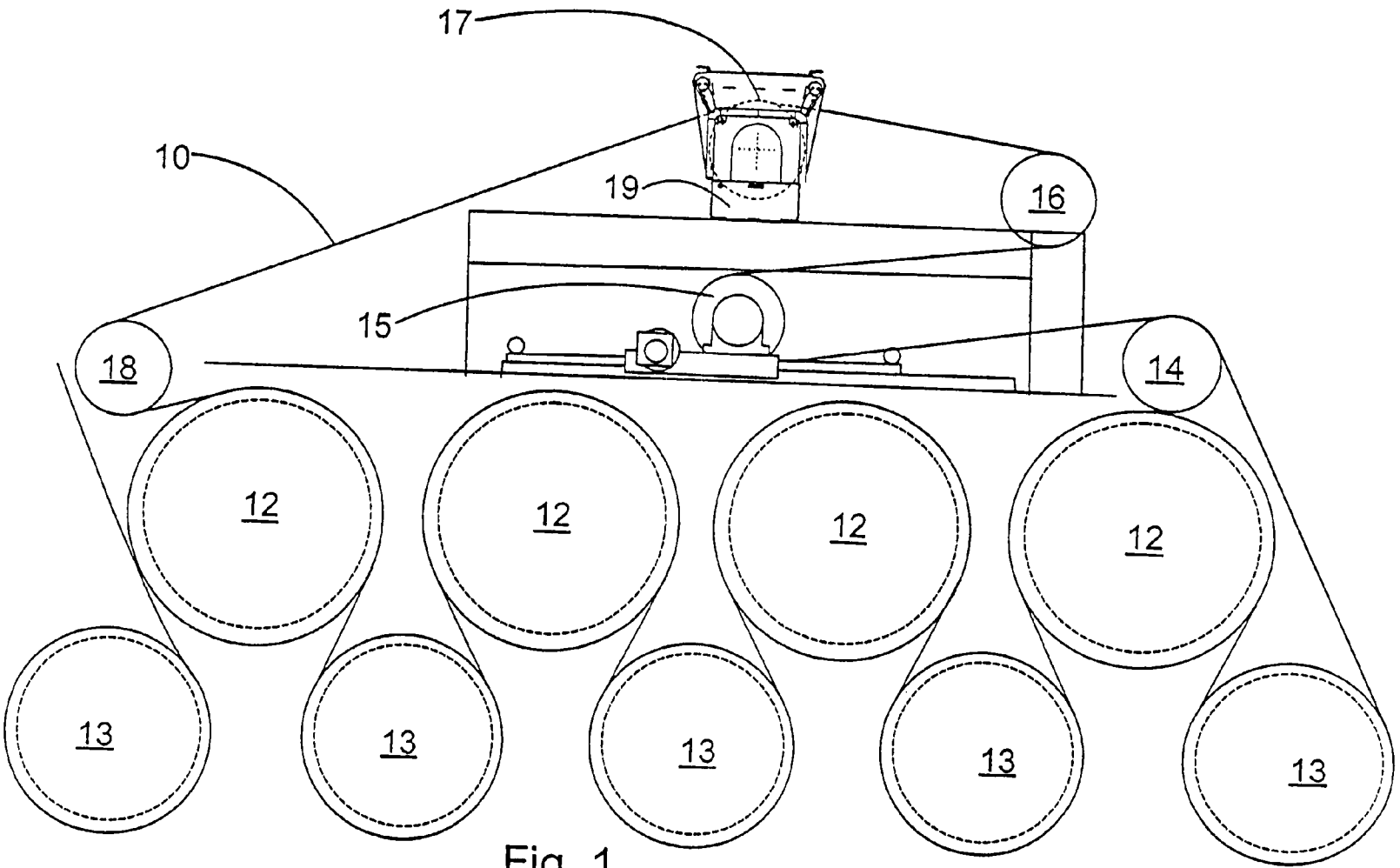
FIG. 1 is a side view of the equipment according to the invention adapted in connection with a roll in a dryer section of a paper machine.

FIG. 1 shows the equipment according to the invention adapted in connection with a roll 17 supporting a paper machine fabric 10. The paper machine comprises at least one fabric arranged as an endless loop. The term paper machine is used here also in reference to a board machine or similar. In the embodiment of FIG. 1 the equipment is arranged to guide a dryer fabric, which passes via dryers 12, Vac rolls 13 and lead rolls 14–18. In addition to the dryer fabric, the equipment can be used to guide a press felt, for example, or another fabric used in a paper machine. In connection with the fabric, generally there is arranged in connection with at least one roll end, equipment according to the invention. Today one paper production line includes as many as 20 guidable fabrics.

Figure 2A:
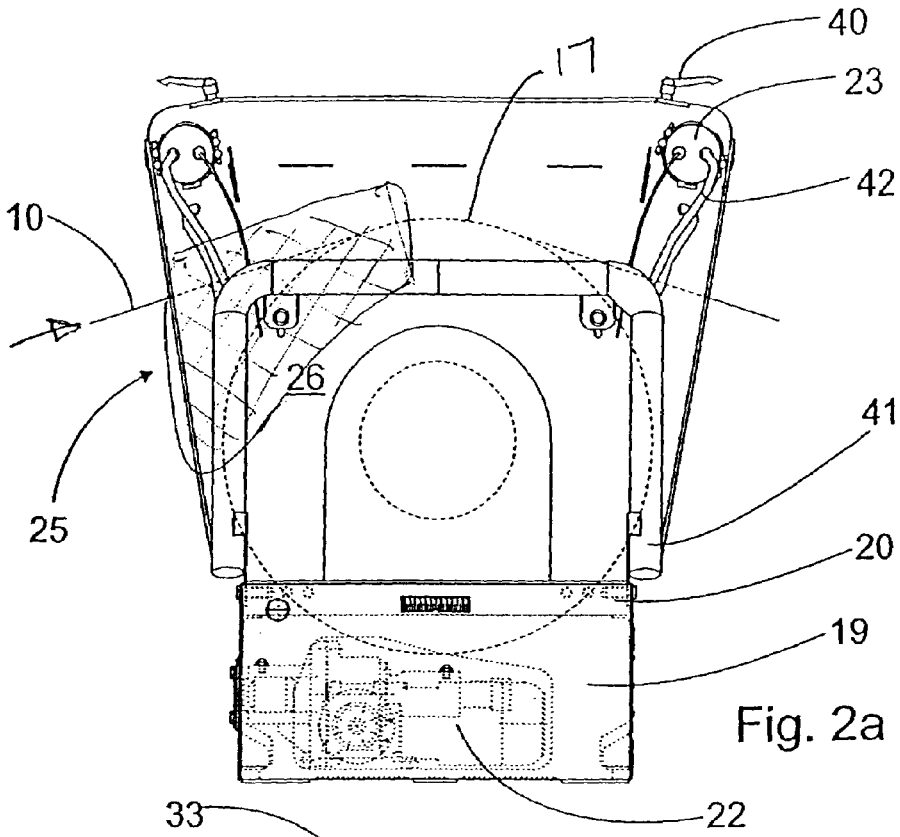
FIG. 2*a* is an enlarged fragmentary view of FIG. 1.
Figure 2B:
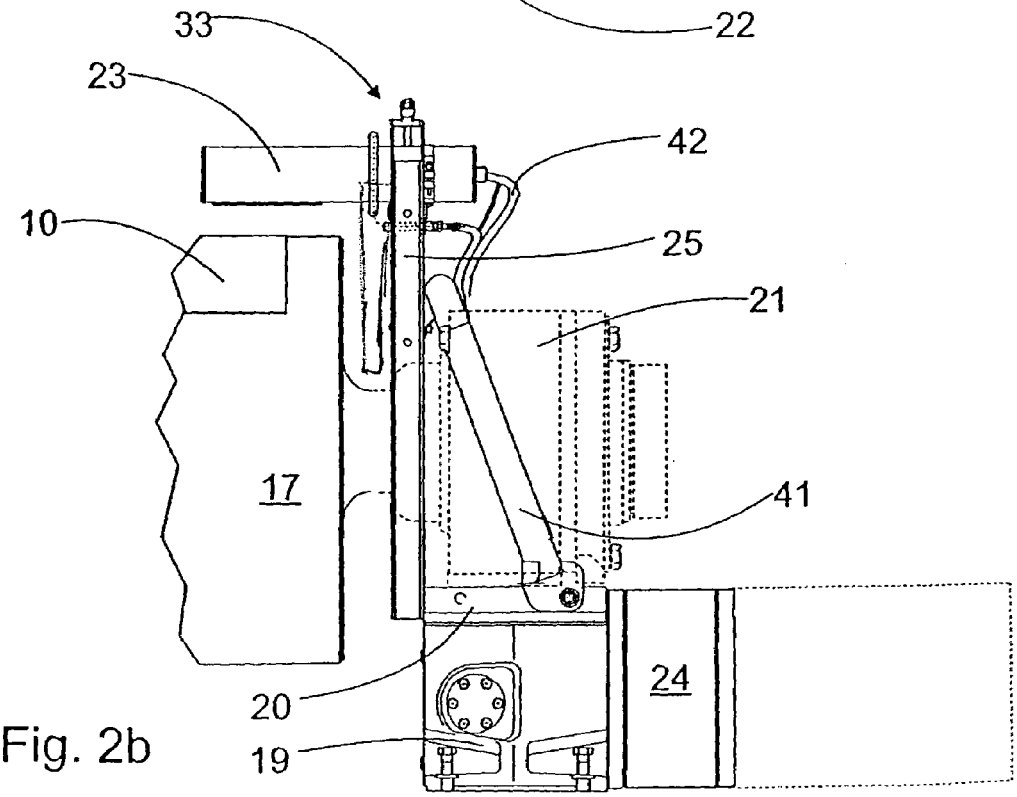
FIG. 2*b* is a machine-directional view of the equipment of FIG. 2*a*.

FIGS. 2*a* and 2*b* provide a more detailed illustration of the equipment according to the invention, including a stand 19 adapted to attach to the paper machine frame as well as a transfer base 20 movably adapted to the stand 19. Here the stand 19 is attached to the frame while the transfer base 20 is movable. Fabric guiding is provided by changing the position of the roll 17. In practice, the bearing pedestal 21 of the roll 17 is attached to the transfer base 20, which thus moves in the machine direction. The bearing assembly of the roll permits this movement, the range of which can be as long as 100 mm. In practice, a movement of a few millimeters is, however, sufficient for providing the desired guiding effect. Inside the stand 19 there is a suitable motor 22, from which the power is usually transmitted to the transfer base 20 by means of a gearing. Furthermore, the transfer base is movably attached to the stand using linear guides (not shown).

The fabric looping at a higher speed continuously moves in the lateral direction as well. Therefore, its guiding must also be continuous. That is, the roll end must be moved all the time to keep the fabric in the desired position. Therefore, the equipment further comprises at least one edge detector 23 for the roll 17, arranged on the opposite side of the fabric 10, which is used to determine the position of the fabric 10 in the axial direction of the roll 17. In this application, a non-contacting edge detector is used, but other types of edge detectors are also possible. preferably there is additionally sufficient amount of electronics in connection with the stand for the automation of the guiding system. In practice, the electronic system continuously compares the measurement results of the edge detector with the set values and, when required, moves the transfer base for the required distance by controlling the motor. Consequently, the roll end supported by the equipment is set according to the edge detector, in which case the fabric position can be maintained as desired in the roll assembly. Here the electronic center 24 is a separate unit located at the side of the stand 19 and can be turned aside during the maintenance of the motor, for example. This is illustrated by the rectangular depicted with broken lines in FIG. 2*b*. The operation of the equipment according to the invention is thus fully independent, which gives more freedom than heretofore for its positioning in various positions.

Figure 3:
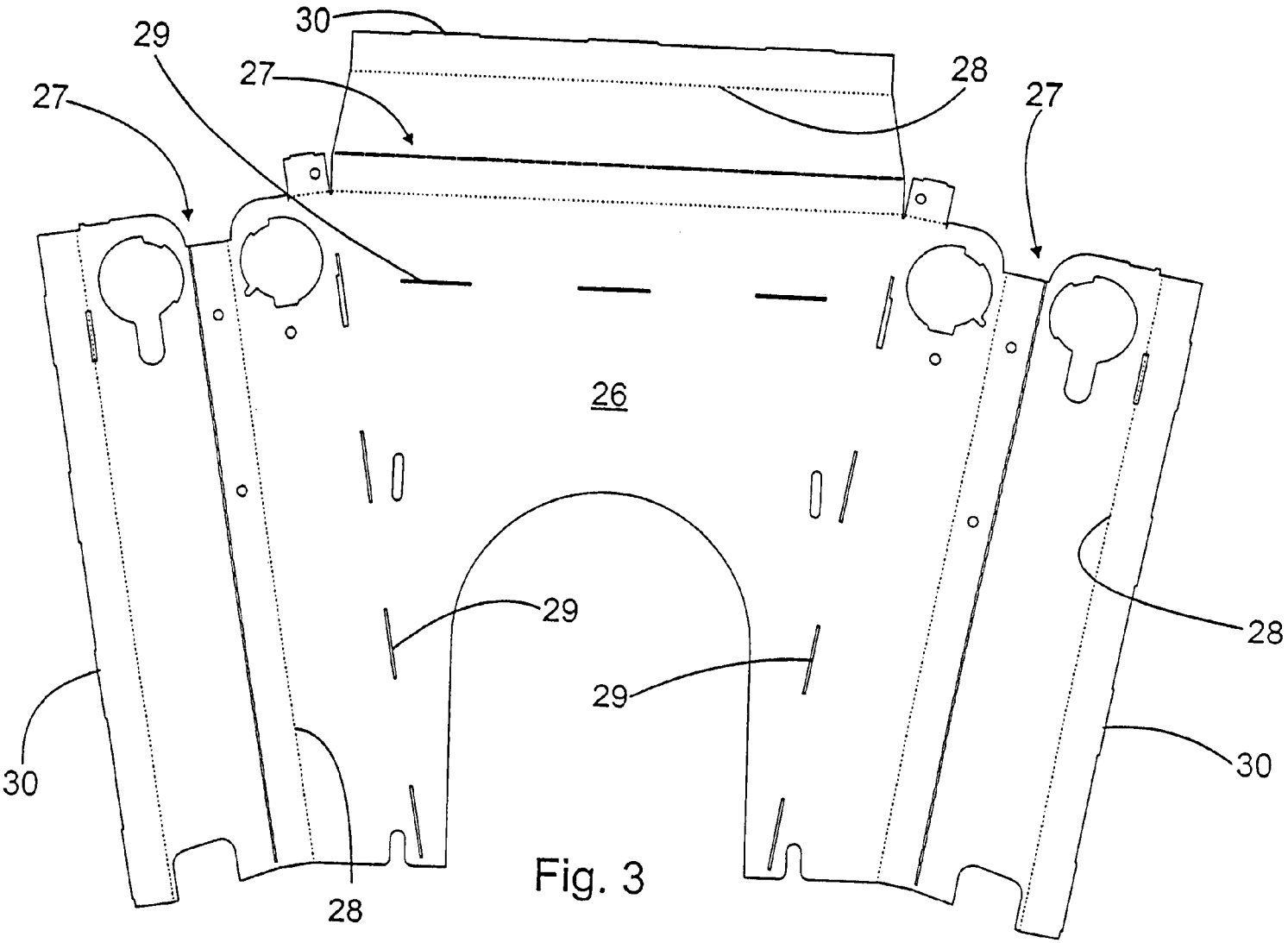
FIG. 3 shows the sheet metal blank for the vertical brackets of the equipment according to the invention.

For attaching the edge detector 23, the stand 19 is provided with a vertical bracket 25. In addition, the stand 19 is provided with a nip guard 26 at the gaps formed by the roll 17 and the fabric 10, preventing, for example, introduction of hands in the said gaps. According to the invention the vertical bracket and the nip guard are unexpectedly formed of an integrated sheet-metal construction. That is, the vertical bracket and the nip guard are of a one-piece construction, made of sheet metal. Consequently, the equipment is lighter in weight, yet more rigid than heretofore. Various fastening elements and supports are also needed less than heretofore. The production can be further simplified by forming the sheet-metal construction from one continuous sheet. This sheet-metal blank is shown in FIG. 3. In practice, the thickness of sheet metal is 1–4 mm, more preferably 2.5–3.5 mm. Due to the demanding operating conditions, it is additionally necessary to use acid-resistant steel. This sets special requirements also for the joining technique.

Figure 4B:
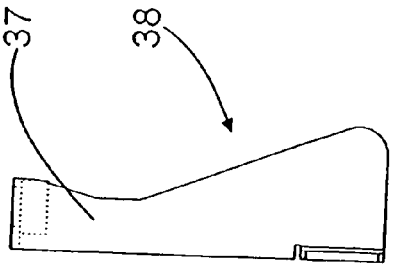
FIG. 4*b* is a side view of the locking device according to the invention.
Figure 4C:
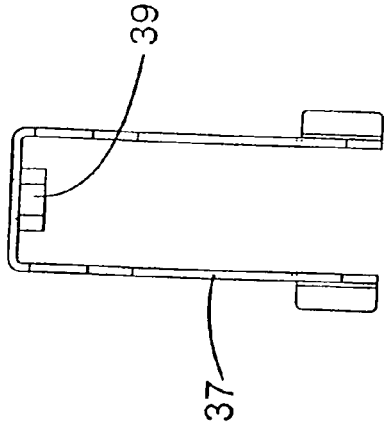
FIG. 4*c* is a front view of the locking device of FIG. 4*b*.
Figure 4A:
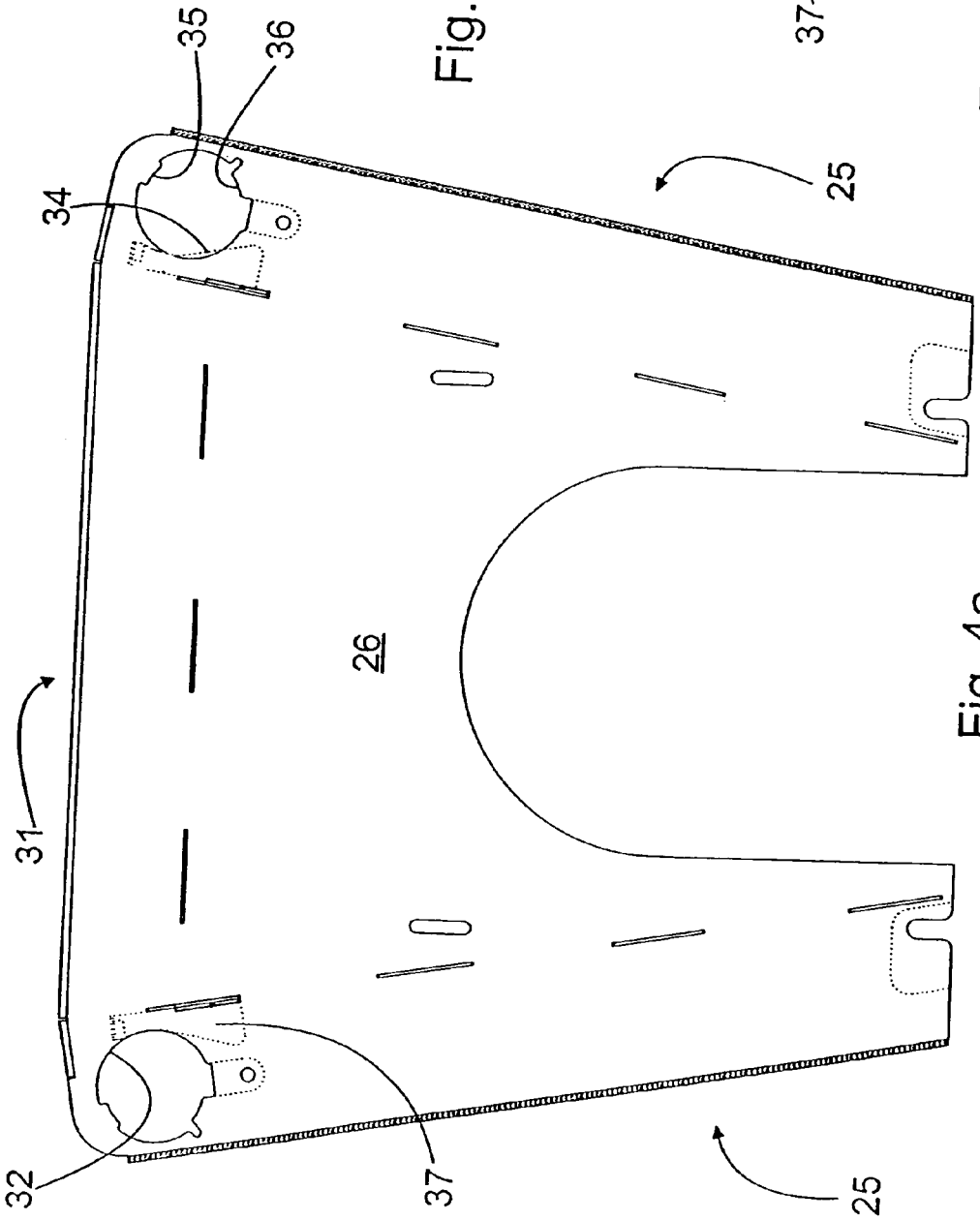
FIG. 4*a* shows the assembly of the sheet metal blank of FIG. 3.

Production problems are easily solved by using both laser cutting and laser welding in the production of the sheet metal according to the invention. In the cutting operation, the sheet-metal blank is additionally provided with perforations 27 enabling a manual bending prior to the manual bending, the sheet-metal blank is provided with bends 28 at the points shown with dot-and-dash lines using an edging press, for example. In this case, the last bending can be made manually, thereby forming a box-type structure. To facilitate the manual bending and especially welding, suitable openings 29 are additionally cut in the sheet-metal blank, with the corresponding projections 30 arranged at the edges of the sheet blank. Consequently, the projections accurately guide manual bending to a correct point, thus providing a box-type structure shown in FIG. 4*a*. After bending, the above mentioned openings together with the projections are welded so as to form a smooth surface. Laser cutting and welding provide a strong and dimensionally accurate construction, which is additionally quick to manufacture. In practical tests it has been easy to achieve an accuracy of 0.1 mm, which is completely sufficient in this application. In addition, the box-type structure is rigid, yet light in weight preferably the equipment comprises two vertical brackets of a box-type structure, in which case the construction becomes symmetric. Rigidity can be easily increased by a horizontal box-type structure 31 arranged between the upper parts of the vertical brackets (FIG. 4*a*). At the same time, the section remaining between the box-type structures forms the nip guard 26.

Separate vertical brackets known in the art have separate fastening elements for fastening the edge detectors. For a similar purpose, according to the invention, arranged in the vertical bracket 25 of a box-type structure there are unexpectedly a mere opening 32 and locking devices 33. Locking is provided with three support points 34–36, arranged at the edges of the opening 32, at uniform intervals in the peripheral direction. In practice, the edge detector is supported by six support points, three on each of the walls of the box-type structure. One of the support points on each wall is formed of the said locking devices 33 for fastening a cylinder-like edge detector. In addition, the locking devices 33 comprise a slide 37 movably adapted in relation to the opening 32, with a wedge surface 38 for fastening edge detectors of different diameters. The slide 37 is shown separated in FIGS. 4*b* and 4*c*, while in FIG. 4*a* it is adapted in its position inside the box-type structure. The slide 37 is also made of sheet metal and there is additionally a nut 39 attached to it. In this case the slide is operated with a threaded bar arranged through a horizontal box-type structure, at the end of which there is a suitable turning handle 40 (FIG. 2*a*). Consequently, the removal and attachment of edge detectors can take place quickly and safely without any tools. The fastening of a rigid and light sheet-metal construction to the stand is also easy. In the bottom part, the sheet-metal construction is fastened using two bolts, while in the upper part, a curved support 41 is used, inside which the cables 42 of the edge detector can be adapted.

It has been possible to replace as many as 50 components, heretofore separate, with the construction of the equipment according to the invention. In addition, the construction is notably lighter in weight, yet more rigid than heretofore. Furthermore, due to the sheet-metal technique, manufacturing of the construction is quick, and the final construction is dimensionally accurate. Even the complete equipment can be mounted in different locations and positions than what is shown in the example applications. Single type equipment can be used in different parts of a paper machine, while in the prior art technique different devices are often acquired for each production section.

What is claimed is:

1. An apparatus for fabric guiding in a paper machine comprising at least one fabric arranged as an endless loop as well as rolls adapted to support it, wherein the rolls include a first roll, and wherein at the end of at least the first roll there is arranged equipment that includes:

a stand adapted to attach to a paper machine frame;

a nip guard in the stand at gaps formed by the first roll and the fabric;

a transfer base movably adapted to the stand;

transfer equipment for moving the transfer base in relation to the stand;

at least one edge detector for the first roll, arranged on the opposite side of the fabric, for determining the fabric position in the axial direction of the first roll; and a vertical bracket arranged to the stand for the edge detector, whereby the first roll end supported by the transfer equipment is adapted to be set according to the edge detector by the transfer equipment for keeping a desired fabric position at the rolls, characterized in that the vertical bracket and the nip guard form an integrated sheet-metal construction.

2. The apparatus of claim 1 wherein the integrated sheet-metal construction is formed of one continuous sheet metal sheet.

3. The apparatus of claim 1 wherein the sheet-metal construction further comprises two vertical brackets, the vertical brackets having upper parts, and wherein between the upper parts there is a horizontal structure.

4. The apparatus of claim 1 wherein the sheet metal construction is formed of sheet metal having a thickness of from 1–4 mm.

5. The apparatus of claim 4 wherein the sheet metal construction is formed of sheet metal having a thickness of from 2.5–3.5 mm.

6. The apparatus of claim 1 wherein there is provided an opening as well as locking devices for fastening the edge detector to the vertical bracket.

7. The apparatus of claim 6 wherein at the edges of the opening there are arranged three support points in the peripheral direction at uniform intervals, of which points one is formed of the said locking devices for fastening a cylindrical edge detector.

8. The apparatus of claim 7 wherein the locking devices include a slide movably adapted in relation to the opening, with a wedge surface for fastening edge detectors of different diameters.

9. A paper machine with an apparatus for fabric guiding, comprising:

a plurality of rolls including a first roll, the first roll rotating about an axis and having an end, the direction of the axis defining an axial direction;

at least one fabric arranged as an endless loop supported on the plurality of rolls, the at least one fabric passing over the first roll, wherein gaps are defined between portions of the fabric and the first roll;

at the end of the first roll there is arranged:

a stand attached to a paper machine frame;

a transfer base movably adapted to the stand;

transfer equipment for moving the transfer base in relation to the stand;

at least one edge detector for the first roll, arranged on the opposite side of the fabric, for determining the fabric position in the axial direction of the first roll; and an integral sheet-metal construction having portions defining a nip guard in the stand at the gaps formed by the first roll and the fabric and a vertical bracket mounted to the stand, the at least one edge detector being fixed to the vertical bracket, wherein a first roll end supported by the transfer equipment is set according to the edge detector by the transfer equipment for keeping a desired fabric position at the rolls.

* * * * *